US006902093B1

(12) United States Patent
Chang

(10) Patent No.: US 6,902,093 B1
(45) Date of Patent: Jun. 7, 2005

(54) CENTERING PUNCH

(76) Inventor: Ji Jong Chang, No. 22, Lane 427, Dasheng Street, Taichung City 408 (TW)

( * ) Notice: Subject to any disclaimer, the term of this patent is extended or adjusted under 35 U.S.C. 154(b) by 61 days.

(21) Appl. No.: 10/865,357

(22) Filed: Jun. 7, 2004

(51) Int. Cl.[7] ..... B25C 1/02
(52) U.S. Cl. ..... 227/132; 227/142; 227/156; 173/124; 173/213
(58) Field of Search ..... 227/147, 132, 227/156; 173/213, 124; 81/44

(56) References Cited

U.S. PATENT DOCUMENTS 843,655 A * 2/1907 Adell et al. ..... 30/367
1,572,046 A * 2/1926 Seiler ..... 30/367
2,384,707 A * 9/1945 Sweet ..... 30/367
2,594,901 A * 4/1952 Forster ..... 173/31
3,172,204 A * 3/1965 Frey ..... 30/367
3,177,952 A * 4/1965 West ..... 173/121
3,279,044 A * 10/1966 Roper ..... 29/739
4,682,412 A * 7/1987 Pfeffer ..... 29/750
5,282,564 A * 2/1994 Vigil Rio ..... 227/14
5,904,284 A * 5/1999 Lin ..... 227/11

* cited by examiner

*Primary Examiner*—Scott A. Smith

(57) ABSTRACT

A centering punch includes a first body, a second body, a punching head, an elastic body, an elastic member, a push member, and a spring. Thus, the tapered portion of the punching head is moved along the tapered face of the first body, and the punching head is moved radially in the receiving chamber of the first body by guidance of the tapered face of the first body, so that the push portion of the push member is in alignment with the control hole of the punching head easily and exactly.

20 Claims, 18 Drawing Sheets

CENTERING PUNCH

BACKGROUND OF THE INVENTION

1. Field of the Invention

The present invention relates to a centering punch, and more particularly to a centering punch that can be centered and aligned easily and exactly.

2. Description of the Related Art

A conventional centering punch in accordance with the prior art shown in FIGS. 15–18 comprises a first body 80 having an inner wall having a first end formed with a receiving recess 803, a mediate portion formed with a tapered face 802 and a second end formed with a receiving chamber 801, a fixing member 83 mounted on the first end of the first body 80, a second body 87 having a first end mounted on the second end of the first body 80 and a second end formed with a passage 872 and having an inside formed with a receiving space 871, a punching head 81 movably mounted in the receiving recess 803 of the first body 80 and having a first end formed with a control hole 811, an elastic member 82 mounted in the receiving recess 803 of the first body 80 and urged between a second end of the punching head 81 and the fixing member 83, a first push member 86 movably mounted in the passage 872 of the second body 87 and having an enlarged first end 860 rested on a shoulder 875 formed between the receiving space 871 and the passage 872 of the second body 87 and a second end protruded outward from the passage 872 of the second body 87, a second push member 84 movably mounted in the receiving space 871 of the second body 87 and having a first end rested on the first end of the punching head 81 and located adjacent to the control hole 811 of the punching head 81 and an enlarged second end 840 rested on the enlarged first end 860 of the first push member 86, and a spring 85 mounted on the second push member 84 and urged between the enlarged second end 840 of the second push member 84 and the first end of the punching head 81.

As shown in FIG. 16, the second push member 84 is rested on the first end of the punching head 81 eccentrically by an elastic force of the spring 85, so that the first end of the second push member 84 is rested on the first end of the punching head 81 and is not in alignment with the control hole 811 of the punching head 81.

As shown in FIG. 17, the second end of the first push member 86 is provided with a socket (not shown) which is mounted on a tool (not shown), such as a nail or the like, which is moved to press a working face (not shown). When the first body 80 is held and driven by a user's one hand to move toward the working face, the first push member 86 is pushed by the reaction of the working face to move toward the punching head 81, so that the second push member 84 is driven to press and move the punching head 81 and to compress the elastic member 82. At this time, the spring 85 is compressed and guided by the tapered face 802 of the first body 80, so that the second push member 84 is moved radially in the receiving space 871 of the second body 87 by guidance of the tapered face 802 of the first body 80 until the first end of the second push member 84 is in alignment with the control hole 811 of the punching head 81.

As shown in FIG. 18, after the first end of the second push member 84 is in alignment with the control hole 811 of the punching head 81, the punching head 81 is driven by the restoring force of the elastic member 82 to hit the second push member 84 which hits the first push member 86, so that the first push member 86 is pushed outward to drive the tool to pierce the working face, thereby forming a hole (not shown) in the working face. At this time, the first end of the second push member 84 is inserted into the control hole 811 of the punching head 81.

However, the first end of the second push member 84 is not easily in alignment with the control hole 811 of the punching head 81, so that the conventional centering punch cannot be centered and aligned exactly, thereby limiting operation of the conventional centering punch.

SUMMARY OF THE INVENTION

The primary objective of the present invention is to provide a centering punch that can be centered and aligned easily and exactly.

Another objective of the present invention is to provide a centering punch, wherein the tapered portion of the punching head is moved along the tapered face of the first body, and the punching head is moved radially in the receiving chamber of the first body by guidance of the tapered face of the first body, so that the push portion of the push member is in alignment with the control hole of the punching head easily and exactly.

A further objective of the present invention is to provide a centering punch, wherein the punching head is located eccentrically in the receiving chamber of the first body by the elastic force of the elastic body, thereby simplifying the construction of the centering punch.

A further objective of the present invention is to provide a centering punch, wherein the push member is rotated by the second body, so that the socket of the push member is rotated to function as a screwdriver head.

Further benefits and advantages of the present invention will become apparent after a careful reading of the detailed description with appropriate reference to the accompanying drawings.

DETAILED DESCRIPTION OF THE INVENTION

Figure 1:
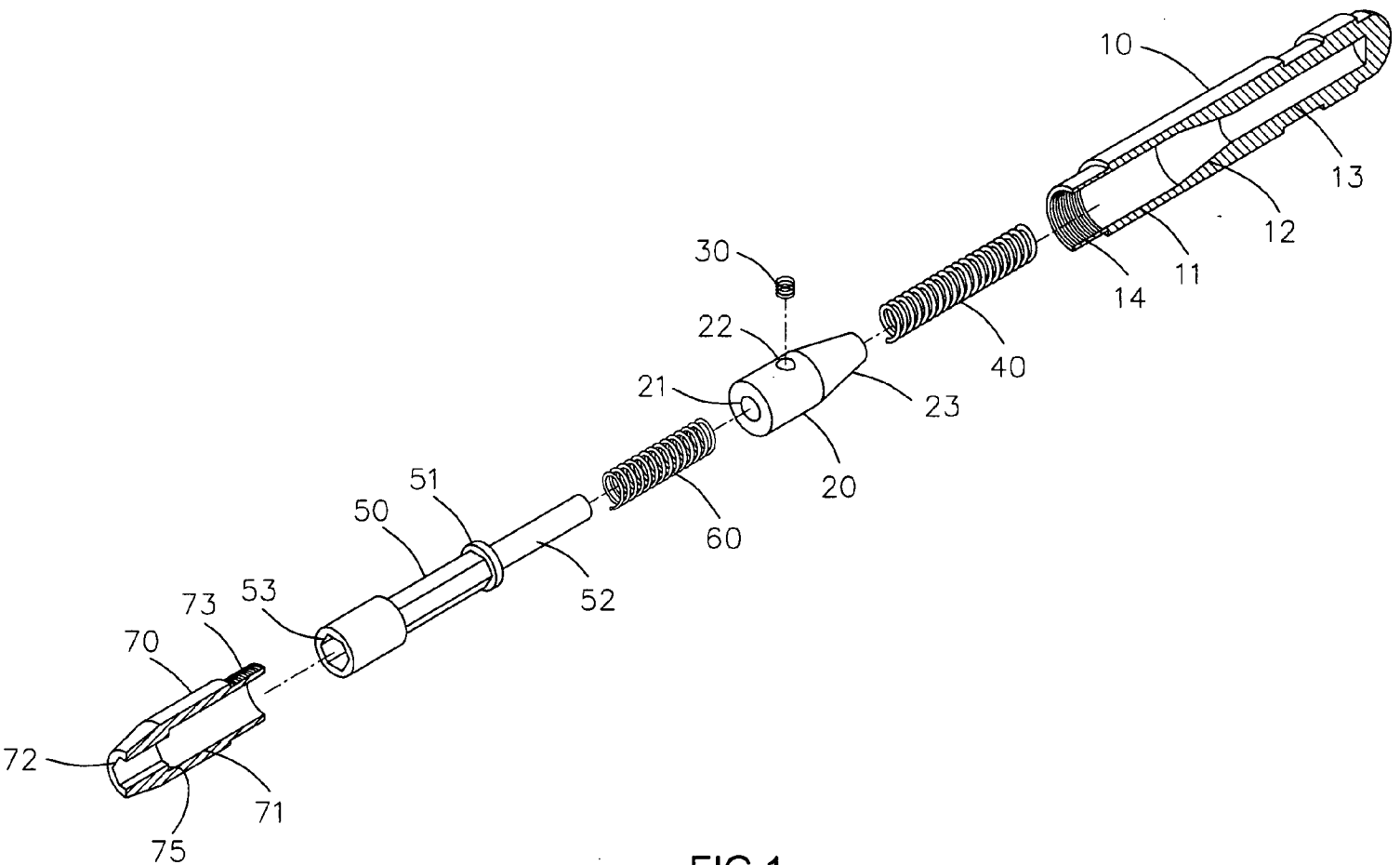
FIG. 1 is an exploded perspective view of a centering punch in accordance with the preferred embodiment of the present invention.
Figure 2:
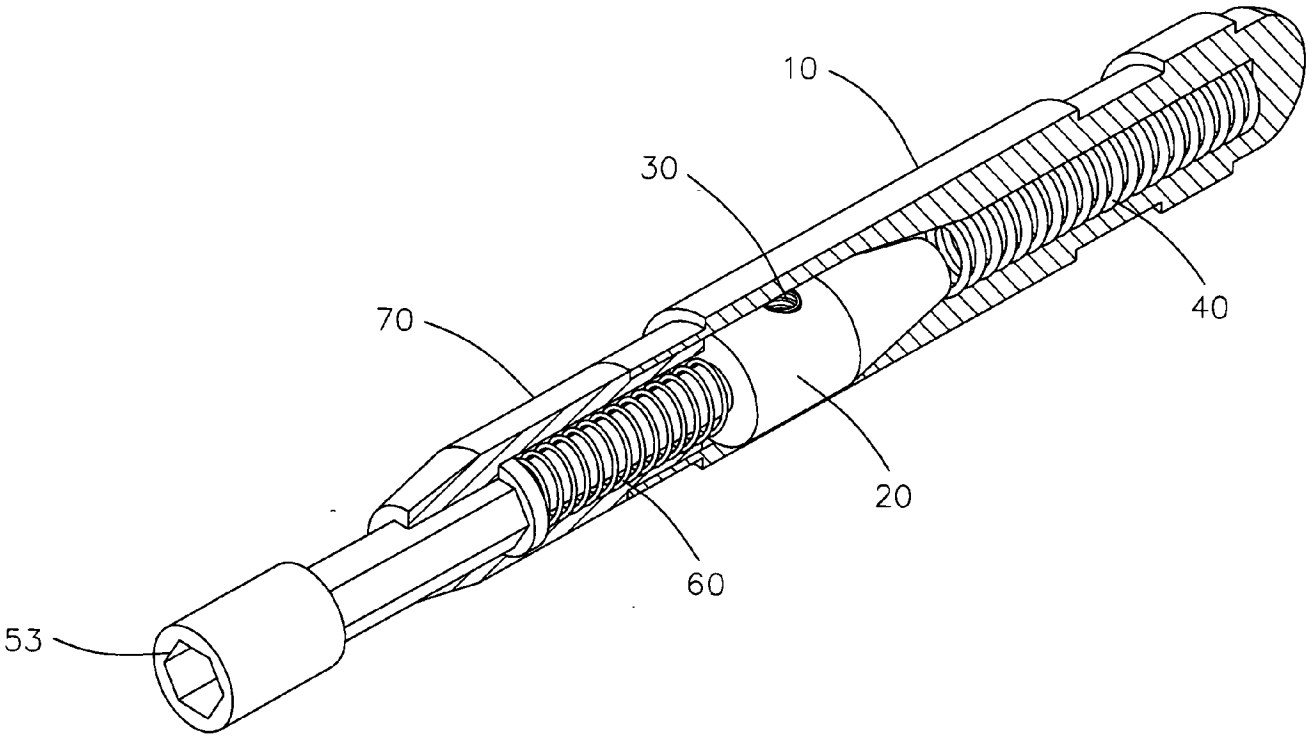
FIG. 2 is a partially cross-sectional perspective assembly view of the centering punch in accordance with the preferred embodiment of the present invention.
Figure 3:
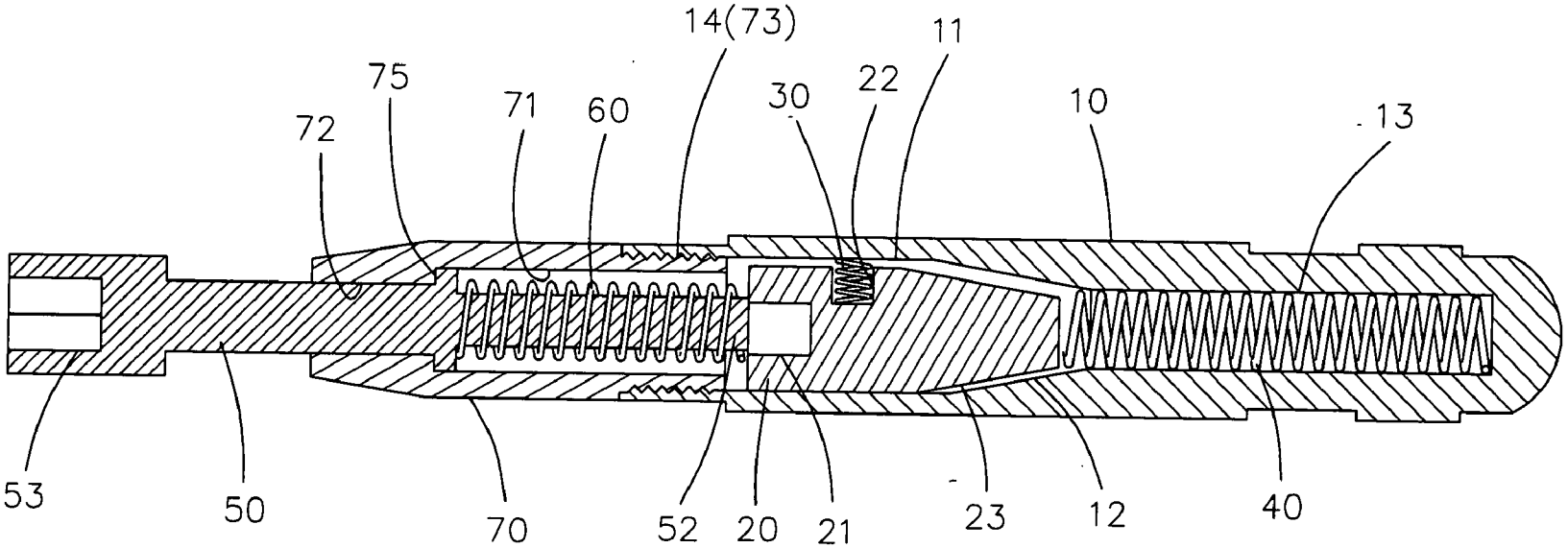
FIG. 3 is a plan cross-sectional view of the centering punch as shown in FIG. 2.

Referring to the drawings and initially to FIGS. 1–3, a centering punch in accordance with the preferred embodiment of the present invention comprises a first body 10, a second body 70, a punching head 20, an elastic body 30, an elastic member 40, a push member 50, and a spring 60.

The first body 10 has an inner wall having a first end formed with a receiving recess 13, a mediate portion formed with a tapered face 12 and a second end formed with a receiving chamber 11. The receiving chamber 11 of the first body 10 has a diameter greater than that of the receiving recess 13 of the first body 10. The second end of the inner wall of the first body 10 has a distal portion formed with an inner thread 14.

The second body 70 is mounted on the first body 10 and has an inside formed with a receiving space 71 communicating with the receiving chamber 11 of the first body 10. The second body 70 has a first end formed with an outer thread 73 screwed into the inner thread 14 of the first body 10 and a second end formed with a non-circular (hexagonal) passage 72.

The punching head 20 is movably mounted in the receiving chamber 11 of the first body 10 and has a first end formed with a tapered portion 23 aligning with the tapered face 12 of the first body 10 and a second end formed with a control hole 21. The punching head 20 has a diameter smaller than that of the receiving chamber 11 of the first body 10.

The elastic body 30 is urged between the receiving chamber 11 of the first body 10 and a periphery of the punching head 20 so that the punching head 20 is located eccentrically in the receiving chamber 11 of the first body 10 by an elastic force of the elastic body 30. Preferably, the periphery of the punching head 20 is formed with a mounting recess 22 for mounting the elastic body 30.

The elastic member 40 is mounted in the receiving recess 13 of the first body 10 and urged between the first body 10 and the tapered portion 23 of the punching head 20.

The push member 50 having a non-circular (hexagonal) shape is movably mounted in the receiving space 71 and the passage 72 of the second body 70 and has a first end provided with a push portion 52 rested on the second end of the punching head 20 and located adjacent to the control hole 21 of the punching head 20 and a second end protruded outward from the passage 72 of the second body 70. The second end of the push member 50 is provided with a socket 53. Preferably, the socket 53 is detachably mounted on the push member 50 to facilitate assembly of the push member 50 in the second body 70. The push member 50 has a mediate portion provided with a catch portion 51 rested on a shoulder 75 formed between the receiving space 71 and the passage 72 of the second body 70.

The spring 60 is mounted on the push portion 52 of the push member 50 and urged between the push member 50 and the punching head 20. The spring 60 has a first end urged on the second end of the punching head 20 and a second end urged on the catch portion 51 of the push member 50.

As shown in FIG. 3, the punching head 20 is located eccentrically in the receiving chamber 11 of the first body 10 by the elastic force of the elastic body 30, so that the push portion 52 of the push member 50 is rested on the second end of the punching head 20 and is not in alignment with the control hole 21 of the punching head 20.

Figure 4:
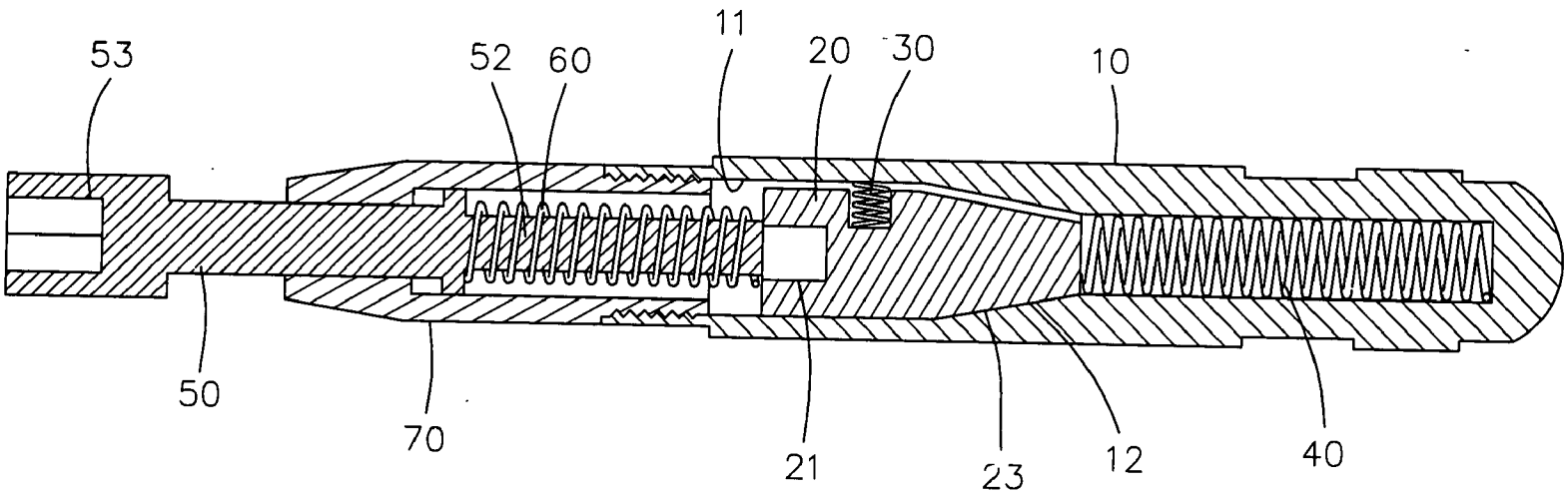
FIG. 4 is a schematic operational view of the centering punch as shown in FIG. 3.
Figure 5:
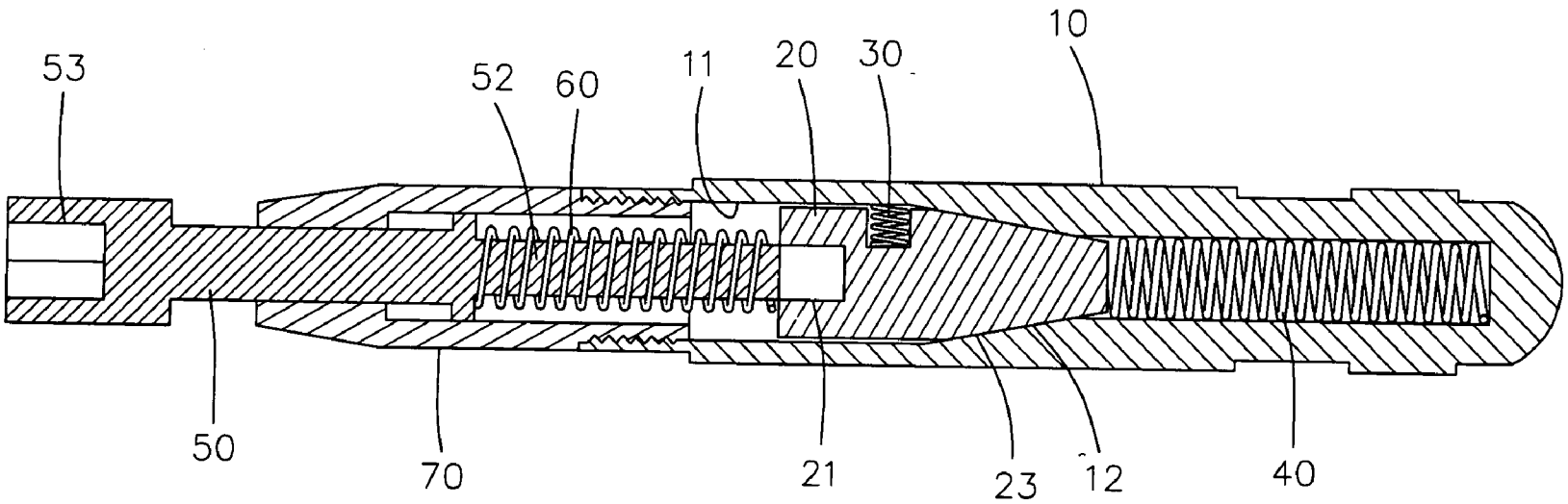
FIG. 5 is a schematic operational view of the centering punch as shown in FIG. 4.

As shown in FIGS. 4 and 5, the socket 53 of the push member 50 is mounted on a tool (not shown), such as a nail or the like, which is moved to press a working face (not shown). When the first body 10 is held and driven by a user's one hand to move toward the working face, the push member 50 is pushed by the reaction of the working face to move toward the punching head 20, so that the push portion 52 of the push member 50 is driven to move the punching head 20 which drives the tapered portion 23 to move along the tapered face 12 of the first body 10 and to compress the elastic member 40. At this time, the punching head 20 is moved radially in the receiving chamber 11 of the first body 10 by guidance of the tapered face 12 of the first body 10, so that the push portion 52 of the push member 50 is in alignment with the control hole 21 of the punching head 20 as shown in FIG. 5.

Figure 6:
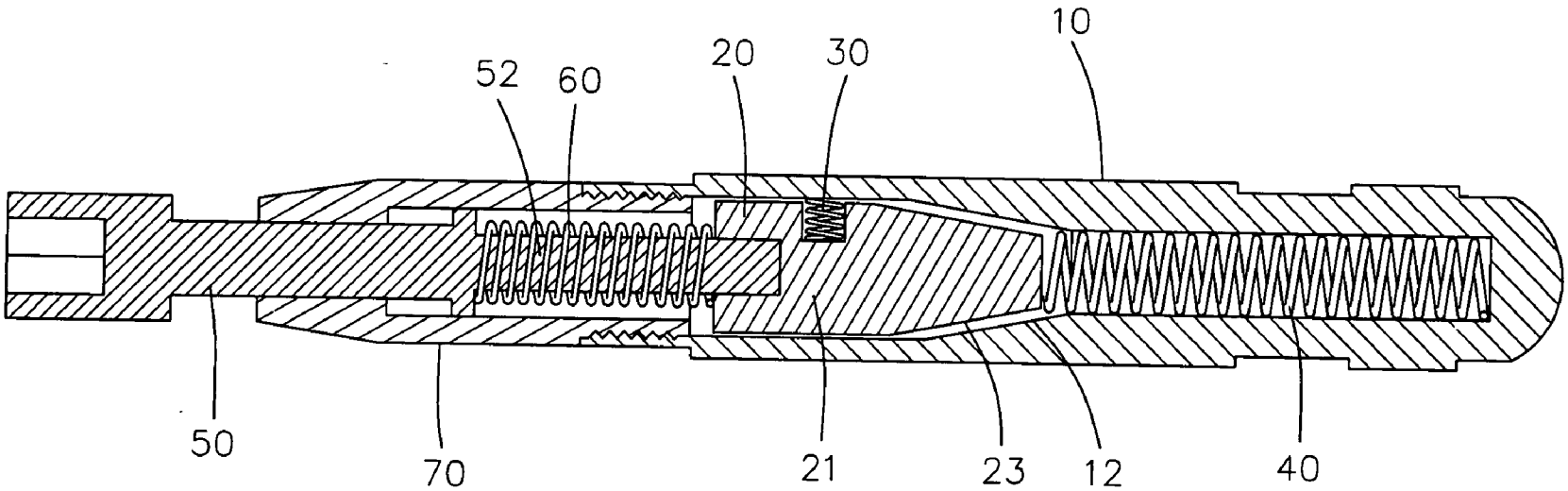
FIG. 6 is a schematic operational view of the centering punch as shown in FIG. 5.

As shown in FIG. 6, after the push portion 52 of the push member 50 is in alignment with the control hole 21 of the punching head 20, the punching head 20 is driven by the restoring force of the elastic member 40 to hit the push member 50, so that the push member 50 is pushed outward to drive the tool to pierce the working face, thereby forming a hole (not shown) in the working face. At this time, the push portion 52 of the push member 50 is inserted into the control hole 21 of the punching head 20, and the spring 60 is compressed by the punching head 20.

After the force applied on the first body 10 is removed, the push member 50 and the punching head 20 are separated from each other by the restoring force of the spring 60, thereby detaching the push portion 52 of the push member 50 from the control hole 21 of the punching head-20, so that the centering punch is returned to the original position as shown in FIG. 3.

Accordingly, the tapered portion 23 of the punching head 20 is moved along the tapered face 12 of the first body 10, and the punching head 20 is moved radially in the receiving chamber 11 of the first body 10 by guidance of the tapered face 12 of the first body 10, so that the push portion 52 of the push member 50 is in alignment with the control hole 21 of the punching head 20 easily and exactly. In addition, the punching head 20 is located eccentrically in the receiving chamber 11 of the first body 10 by the elastic force of the elastic body 30, thereby simplifying the construction of the centering punch. Further, the push member 50 is rotated by the second body 70, so that the socket 53 of the push member 50 is rotated to function as a screwdriver head.

Figure 7:
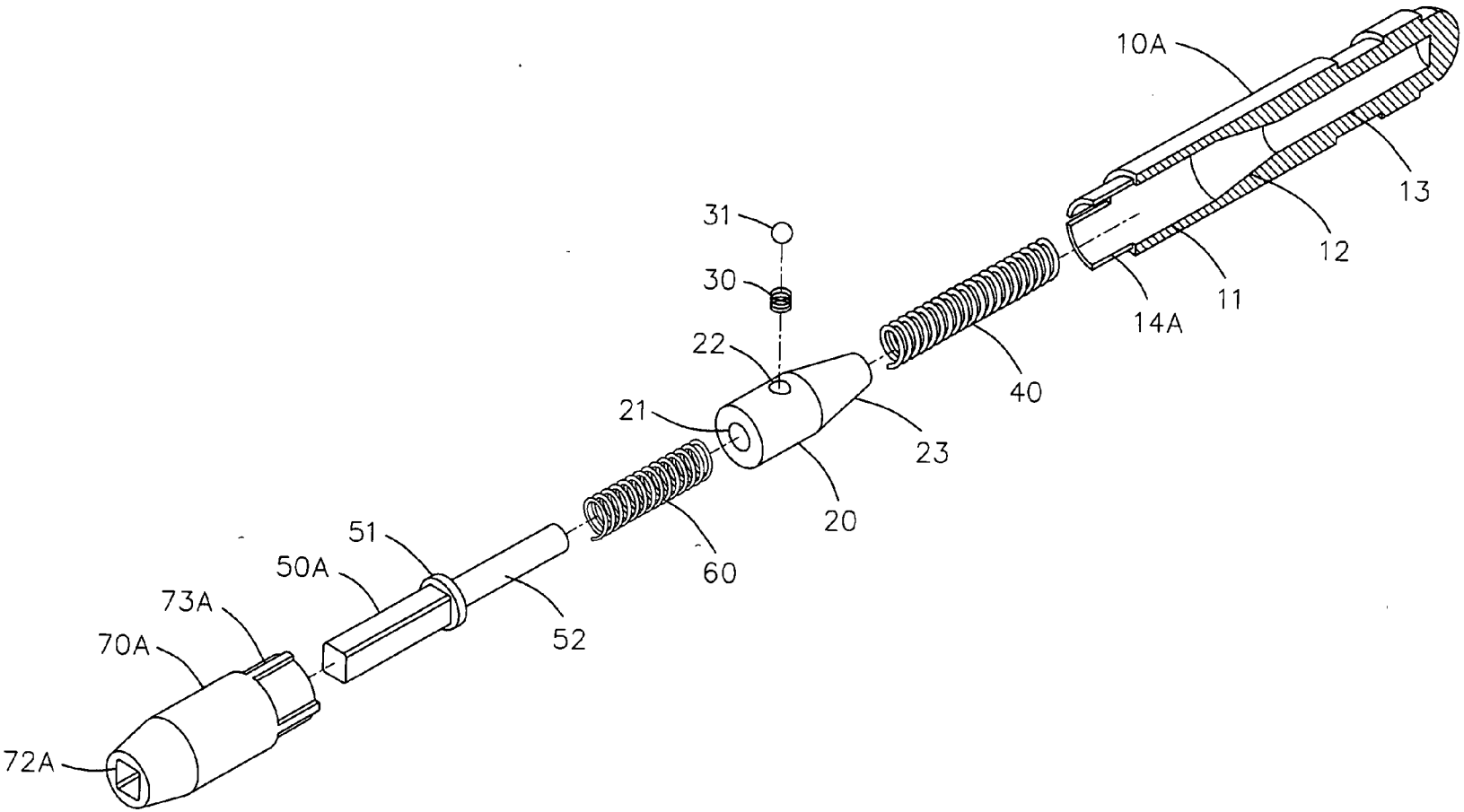
FIG. 7 is an exploded perspective view of a centering punch in accordance with another embodiment of the present invention.

Referring to FIG. 7, the centering punch further comprises a ball 31 urged between the receiving chamber 11 of the first body 10 and the elastic body 30. In addition, the first end of the inner wall of the-first body 10A has a distal portion formed with a plurality of insertion recesses 14A, and the second body 70A has a first end formed with a plurality of inserts 73A each inserted into a respective one of the insertion recesses 14A of the first body 10A. In addition, the push member 50A has a square shape, and the second body 70A has a second end formed with a square passage 72A.

Figure 8:
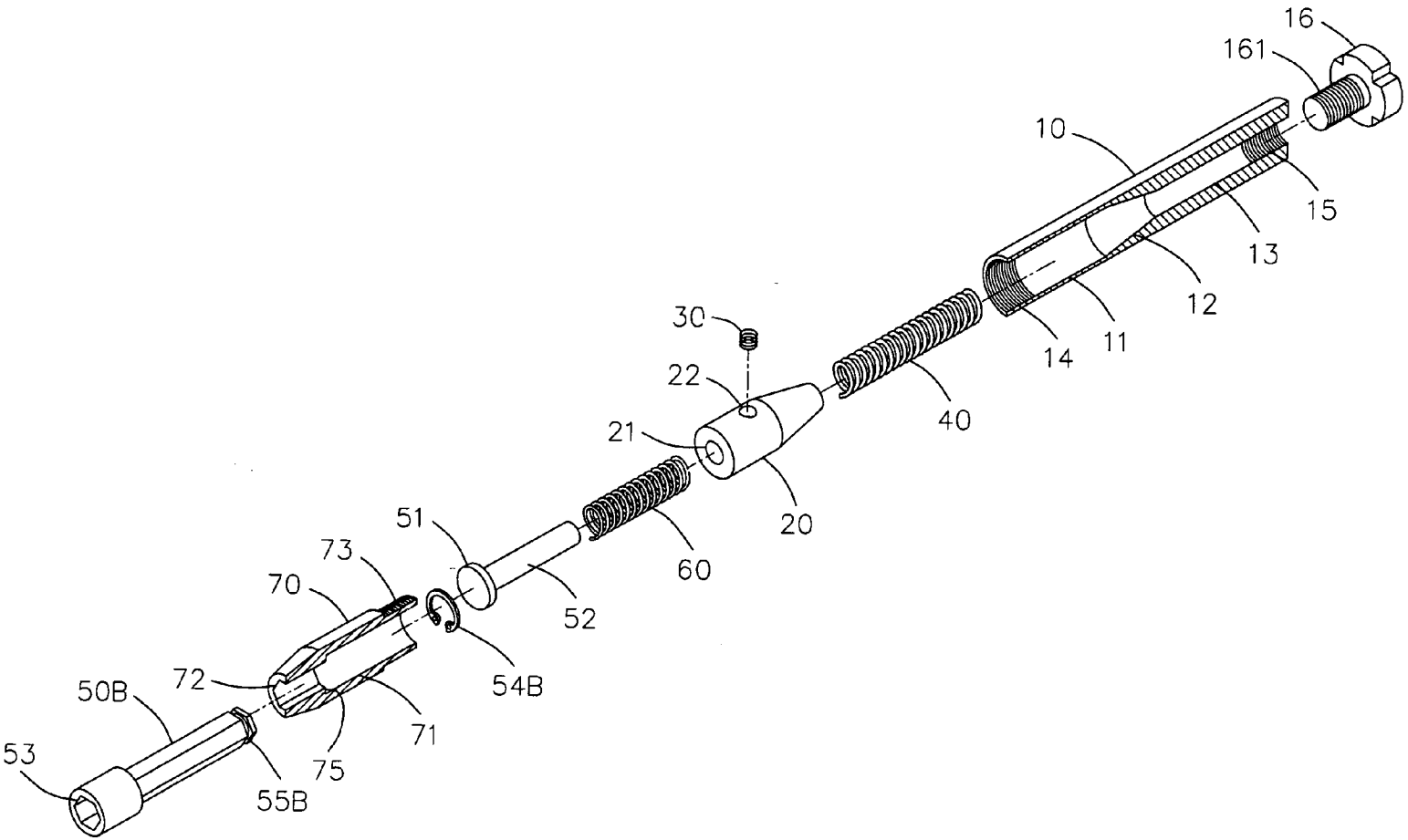
FIG. 8 is an exploded perspective view of a centering punch in accordance with another embodiment of the present invention.
Figure 9:
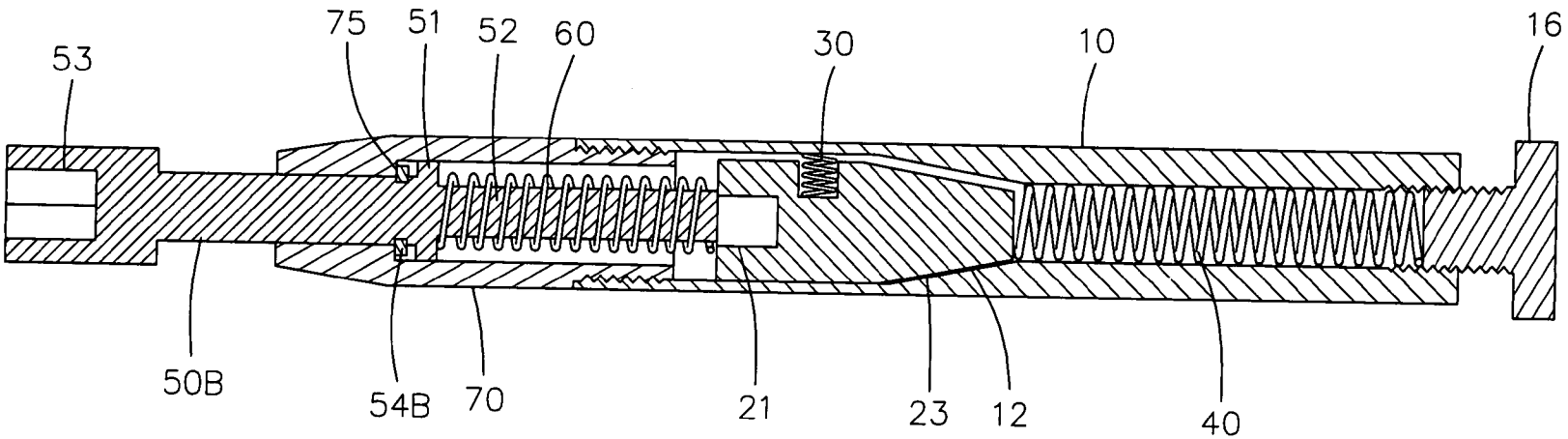
FIG. 9 is a plan cross-sectional view of the centering punch as shown in FIG. 8.
Figure 10:
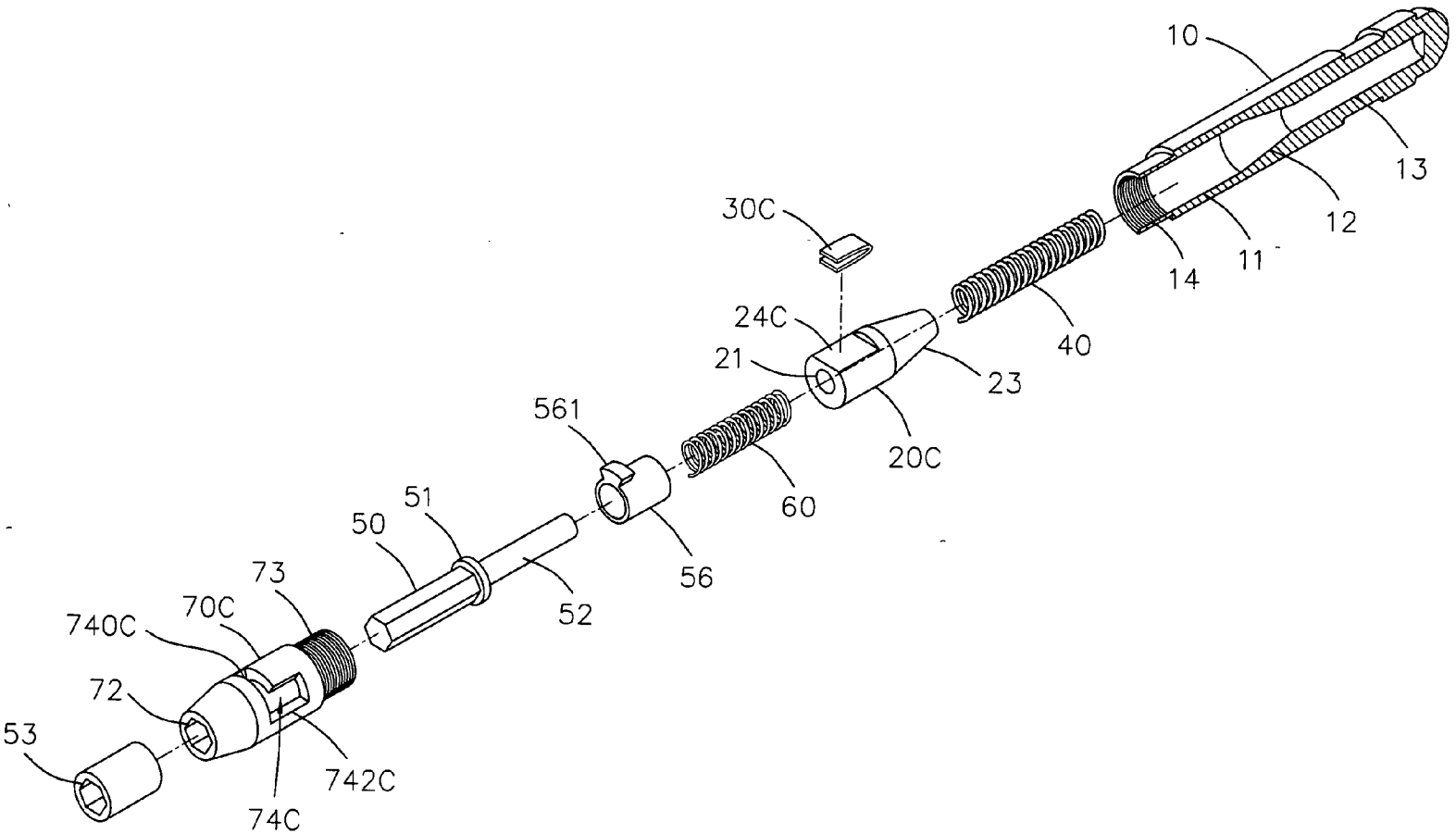
FIG. 10 is an exploded perspective view of a centering punch in accordance with another embodiment of the present invention.

Referring to FIGS. 8 and 9, the first end of the inner wall of the first body 10 has a distal portion formed with an inner thread 15, and the centering punch further comprises an adjusting knob 16 rotatably mounted on the first body 10 and having a threaded rod 161 screwed into the inner thread 15 of the first body 10 and urged on the elastic member 40 to adjust the tension of the elastic member 40. In addition, the push member SOB is separated from the catch portion 51 and the push portion 52 and has a first end rested on the catch portion 51 and formed with a retaining groove 55B, and the centering punch further comprises a snap ring 54B snapped into the retaining groove 55B of the push member SOB and rested on the shoulder 75 formed between the receiving space 71 and the passage 72 of the second body 70.

Referring to FIGS. 10–13, the periphery of the punching head 20C is formed with a flattened face 24C rested on the elastic body 30C. In addition, the socket 53 is detachably mounted on the push member 50. In addition, the second body 70C has a peripheral wall formed with a substantially L-shaped guide slot 74C communicating with the receiving space 71 and having a transverse section 740C and an axial section 742C, and the centering punch further comprises a tubular control member 56 rotatably mounted on the push portion 52 of the push member 50 and having an end rested on the catch portion 51 of the push member 50 and provided with a control block 561 slidably mounted in the guide slot 74C of the second body 70C and located between the transverse section 740C and the axial section 742C of the guide slot 74C. Preferably, the control block 561 is detachably mounted on the control member 56.

Figure 11:
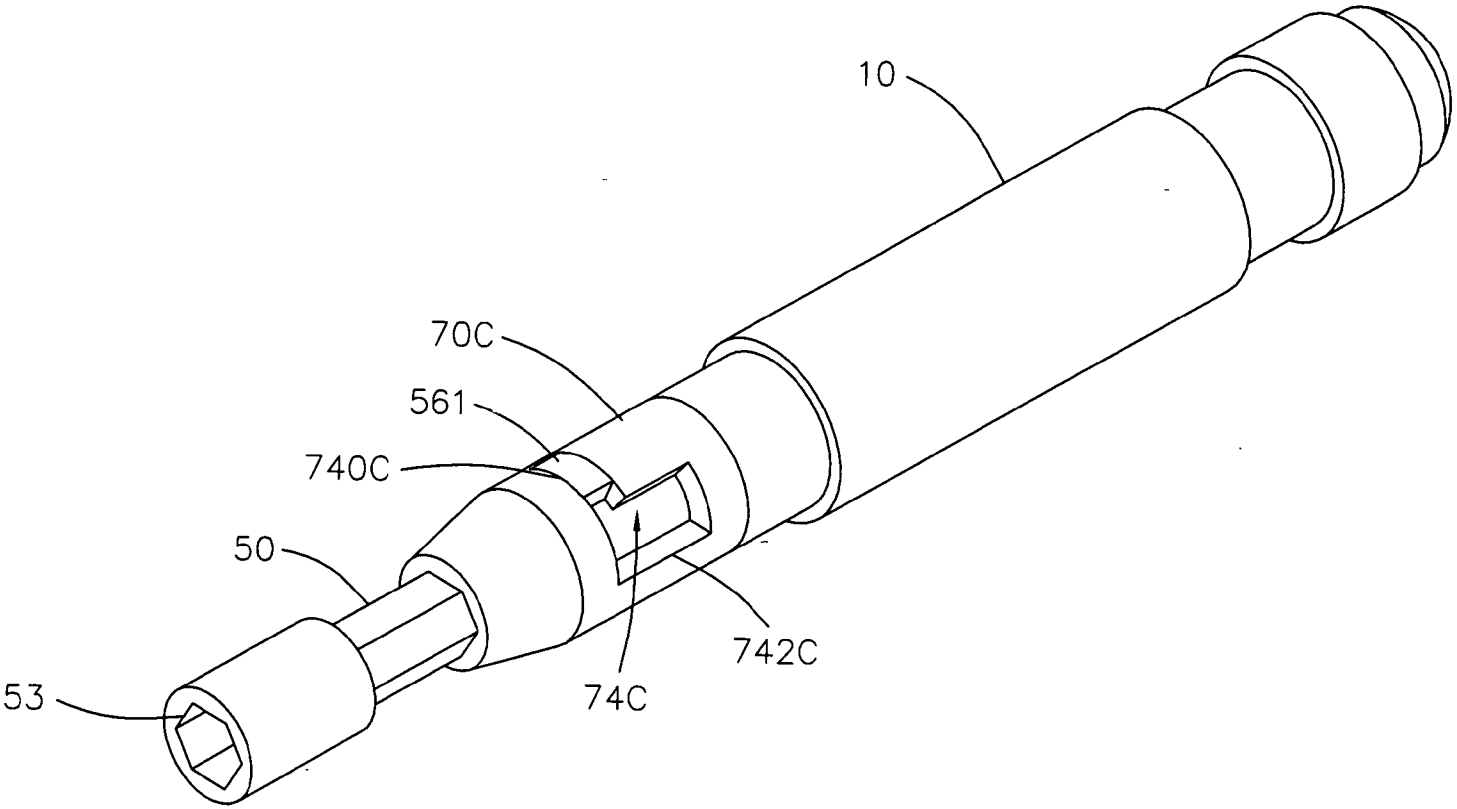
FIG. 11 is a perspective assembly view of the centering punch as shown in FIG. 10.
Figure 12:
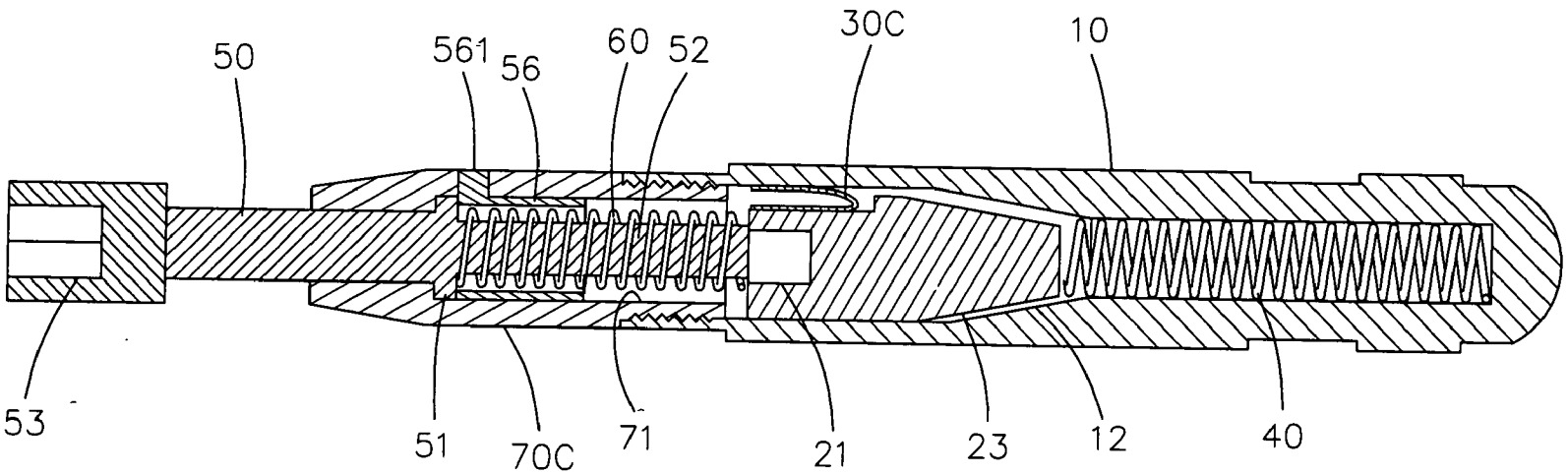
FIG. 12 is a plan cross-sectional view of the centering punch as shown in FIG. 11.

As shown in FIGS. 11 and 12, the control block 561 of the control member 56 is located in the transverse section 740C of the guide slot 742C, so that the control member 56 is fixed on the second body 70C and the push member 5 is fixed by the control member 0.56 without movement.

Figure 13:
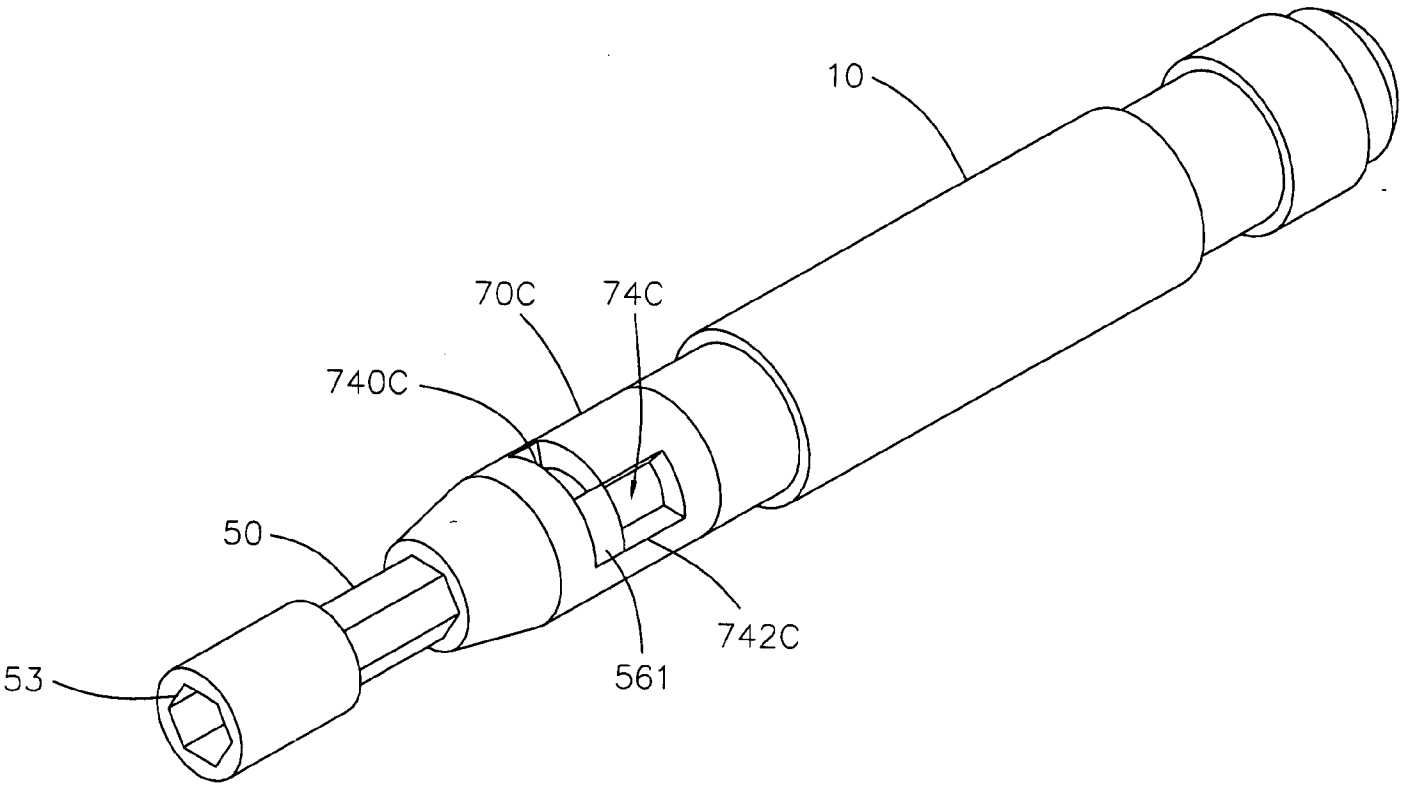
FIG. 13 is a schematic operational view of the centering punch as shown in FIG. 11.

As shown in FIG. 13, the control block 561 of the control member 56 is located in the axial section 742C of the guide slot 74C, so that the control member 56 is movable relative to the second body 70C and the push member 50 is movable freely.

Figure 14:
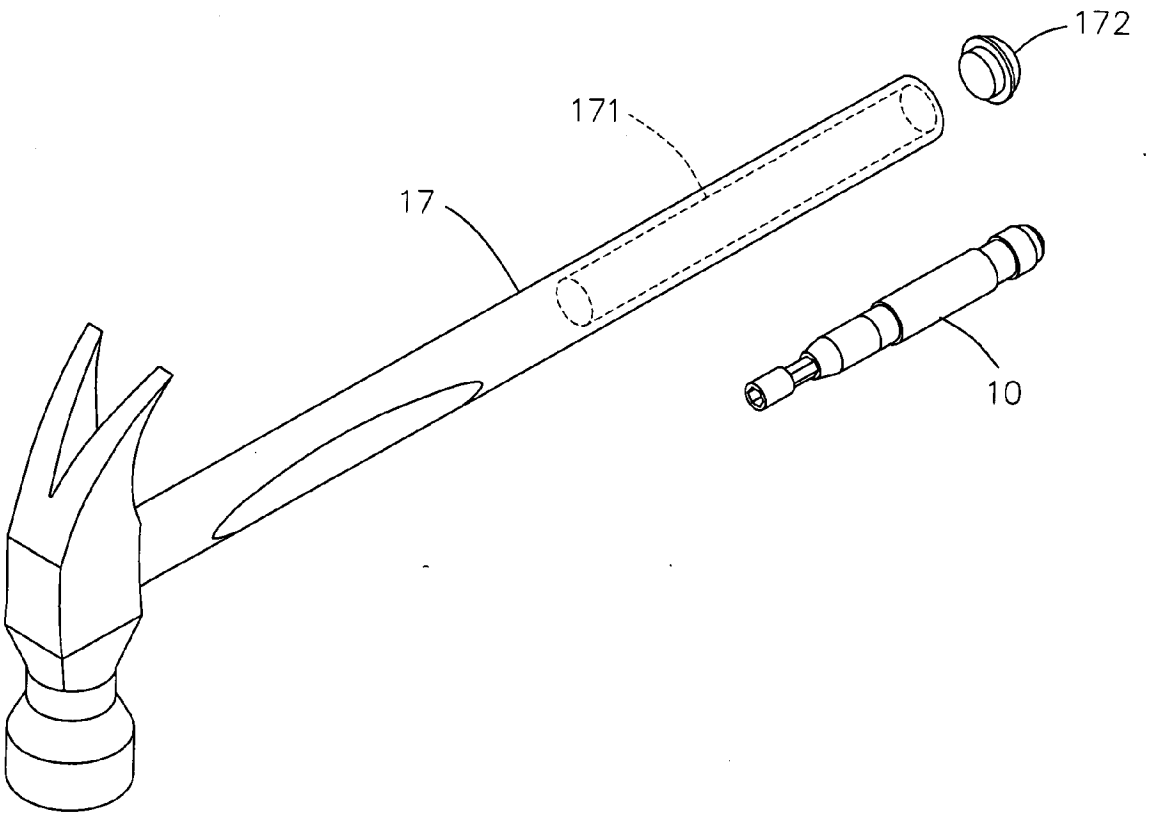
FIG. 14 is an exploded perspective view of a centering punch in accordance with another embodiment of the present invention.
Figure 15:
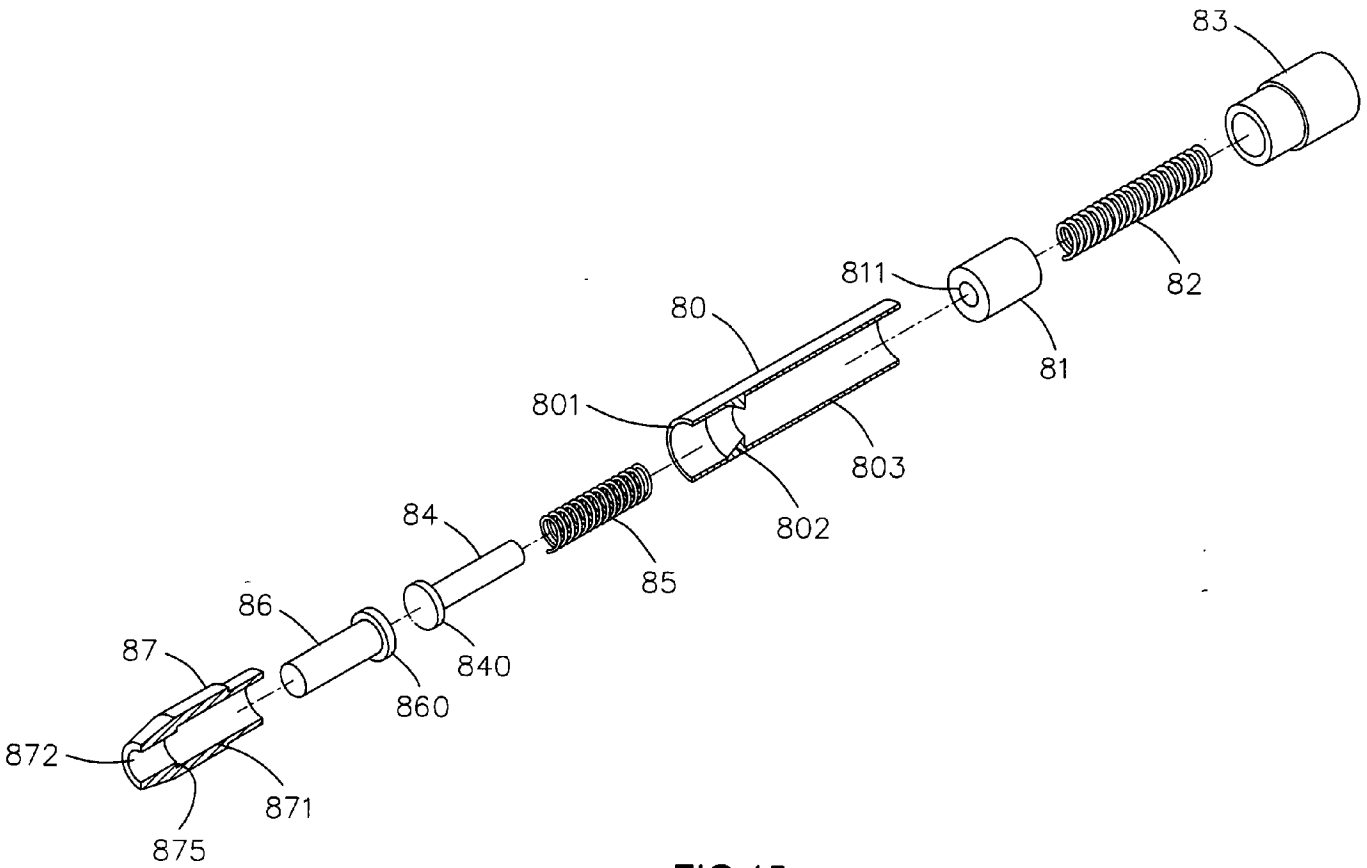
FIG.15 PRIOR ART
FIG. 15 is an exploded perspective view of a conventional centering punch in accordance with the prior art.
Figure 16:
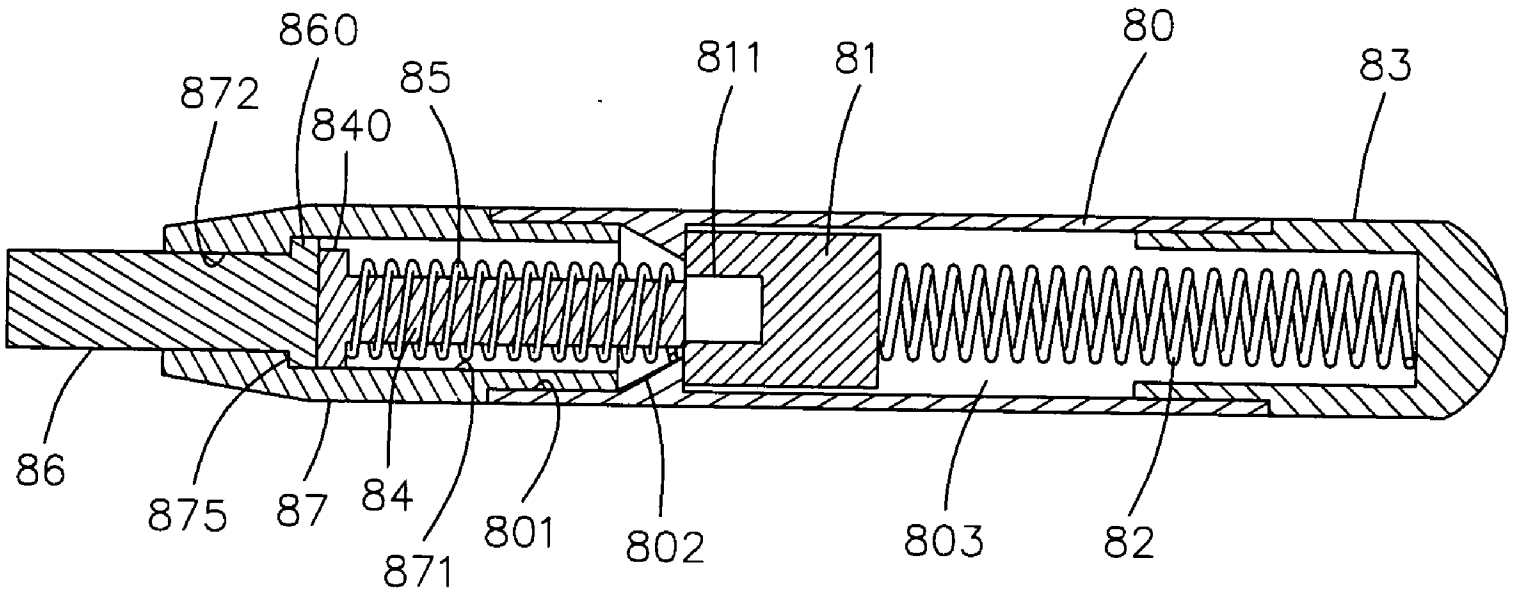
FIG.16 PRIOR ART
FIG. 16 is a plan cross-sectional assembly view of the conventional centering punch as shown in FIG. 15.
Figure 17:
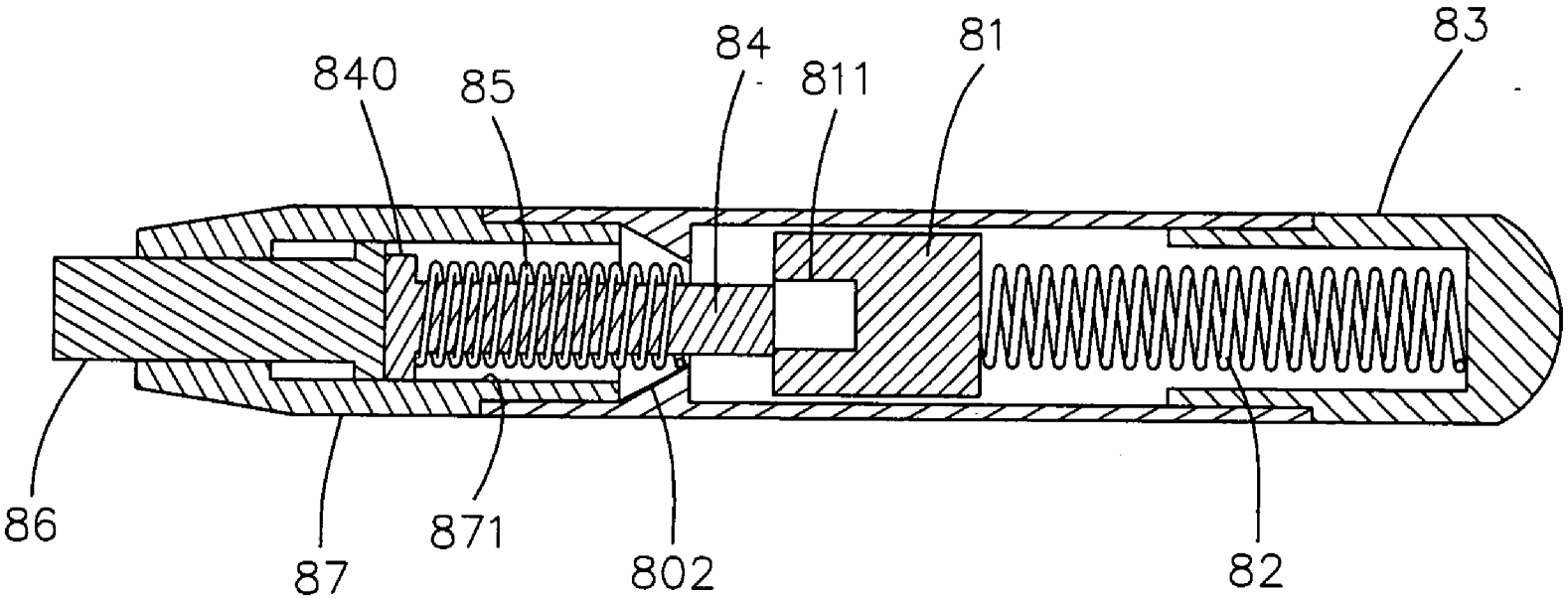
FIG.17 PRIOR ART
FIG. 17 is a schematic operational view of the conventional centering punch as shown in FIG. 16.
Figure 18:
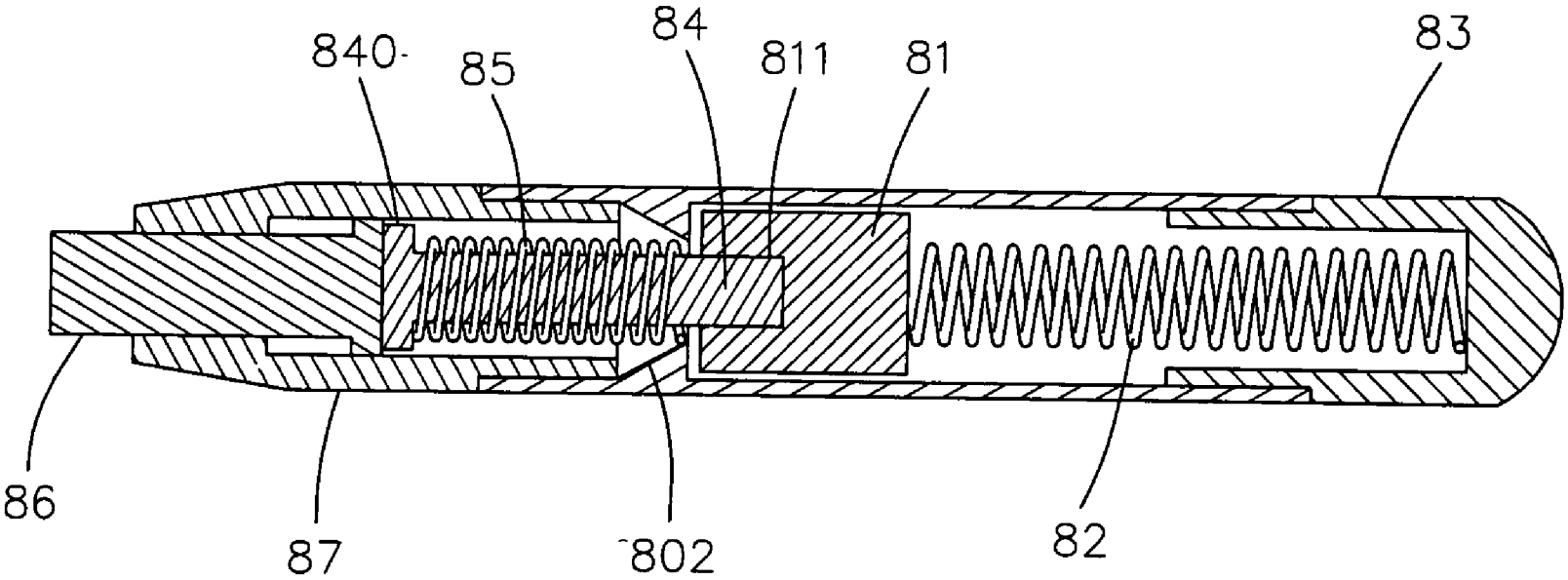
FIG.18 PRIOR ART
FIG. 18 is a schematic operational view of the conventional centering punch as shown in FIG. 17.

As shown in FIG. 14, the centering punch is mounted in a receiving portion 171 of a hammer 17 and covered by a tap 172.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A centering punch, comprising a first body, a second body, a punching head, an elastic body, an elastic member, a push member, and a spring, wherein:

the first body has an inner wall having a first end formed with a receiving recess, a mediate portion formed with a tapered face and a second end formed with a receiving chamber;

the second body is mounted on the first body and has an inside formed with a receiving space;

the punching head is movably mounted in the receiving chamber of the first body and has a first end formed with a tapered portion aligning with the tapered face of the first body and a second end formed with a control hole;

the elastic body is urged between the receiving chamber of the first body and a periphery of the punching head so that the punching head is located eccentrically in the receiving chamber of the first body by an elastic force of the elastic body;

the elastic member is mounted in the receiving recess of the first body and urged between the first body and the tapered portion of the punching head;

the push member is movably mounted in the receiving space of the second body and has a first end provided with a push portion rested on the second end of the punching head and located adjacent to the control hole of the punching head and a second end protruded outward from the second body; and the spring is mounted on the push portion of the push member and urged between the push member and the punching head.

2. The centering punch in accordance with claim 1, wherein the second end of the inner wall of the first body has a distal portion formed with an inner thread, and the second body has a first end formed with an outer thread screwed into the inner thread of the first body.

3. The centering punch in accordance with claim 1, wherein the receiving chamber of the first body has a diameter greater than that of the receiving recess of the first body.

4. The centering punch in accordance with claim 1, wherein the punching head has a diameter smaller than that of the receiving chamber of the first body.

5. The centering punch in accordance with claim 1, wherein the periphery of the punching head is formed with a mounting recess for mounting the elastic body.

6. The centering punch in accordance with claim 1, wherein the second body has a second end formed with a non-circular passage, and the push member has a non-circular shape and is movably mounted in the receiving space and the passage of the second body.

7. The centering punch in accordance with claim 1, wherein the second body has a second end formed with a hexagonal passage, and the push member has a hexagonal shape and is movably mounted in the receiving space and the passage of the second body.

8. The centering punch in accordance with claim 1, wherein the second end of the push member is provided with a socket.

9. The centering punch in accordance with claim 8, wherein the socket is detachably mounted on the push member to facilitate assembly of the push member in the second body.

10. The centering punch in accordance with claim 1, wherein the push member has a mediate portion provided with a catch portion rested on a shoulder formed between the receiving space and the passage of the second body.

11. The centering punch in accordance with claim 10, wherein the spring has a first end urged on the second end of the punching head and a second end urged on the catch portion of the push member.

12. The centering punch in accordance with claim 1, further comprising a ball urged between the receiving chamber of the first body and the elastic body.

13. The centering punch in accordance with claim 1, wherein the first end of the inner wall of the first body has a distal portion formed with a plurality of insertion recesses, and the second body has a first end formed with a plurality of inserts each inserted into a respective one of the insertion recesses of the first body.

14. The centering punch in accordance with claim 1, wherein the push member has a square shape, and the second body has a second end formed with a square passage.

15. The centering punch in accordance with claim 1, wherein the first end of the inner wall of the first body has a distal portion formed with an inner thread, and the centering punch further comprises an adjusting knob rotatably mounted on the first body and having a threaded rod screwed into the inner thread of the first body and urged on the elastic member to adjust the tension of the elastic member.

16. The centering punch in accordance with claim 10, wherein the push member is separated from the catch portion and the push portion and has a first end rested on the catch portion and formed with a retaining groove, and the centering punch further comprises a snap ring snapped into the retaining groove of the push member and rested on a shoulder formed between the receiving space and the passage of the second body.

17. The centering punch in accordance with claim 1, wherein the periphery of the punching head is formed with a flattened face rested on the elastic body.

18. The centering punch in accordance with claim 1, wherein the second body has a peripheral wall formed with a substantially L-shaped guide slot communicating with the receiving space and having a transverse section and an axial section, and the centering punch further comprises a tubular control member rotatably mounted on the push portion of the push member and having an end rested on the catch portion of the push member and provided with a control block slidably mounted in the guide slot of the second body and located between the transverse section and the axial section of the guide slot.

19. The centering punch in accordance with claim 18, wherein the control block is detachably mounted on the control member.

20. The centering punch in accordance with claim 1, wherein the centering punch is mounted in a receiving portion of a hammer and covered by a tap.

* * * * *